US009517177B2

(12) United States Patent
Oh et al.

(10) Patent No.: US 9,517,177 B2
(45) Date of Patent: Dec. 13, 2016

(54) SAUNA APPARATUS FOR HALF-BODY BATH

(71) Applicant: NEWGENSAUNA CO., LTD., Gyeonggi-do (KR)

(72) Inventors: Se Jung Oh, Gyeonggi-do (KR); Min Souk Kim, Seoul (KR)

(73) Assignee: NEWGENSAUNA CO., LTD., Siheung-si, Gyeonggi-do (KR)

( * ) Notice: Subject to any disclaimer, the term of this patent is extended or adjusted under 35 U.S.C. 154(b) by 0 days.

(21) Appl. No.: 14/736,031

(22) Filed: Jun. 10, 2015

(65) Prior Publication Data

US 2016/0081875 A1 Mar. 24, 2016

(30) Foreign Application Priority Data

Sep. 18, 2014 (KR) ..... 10-2014-0124404

(51) Int. Cl.
*A61H 33/06* (2006.01)

(52) U.S. Cl.
CPC ..... *A61H 33/067* (2013.01); *A61H 2033/061* (2013.01)

(58) Field of Classification Search
CPC ..... A61H 33/16
USPC ..... 4/524–534
See application file for complete search history.

(56) References Cited

U.S. PATENT DOCUMENTS

| | | | | |
|---|---|---|---|---|
| 4,340,981 | A * | 7/1982 | Vanags | A61H 33/06 4/524 |
| 5,950,254 | A * | 9/1999 | Yasue | A61H 33/063 4/524 |
| 6,339,854 | B1 * | 1/2002 | Amendt | A61H 33/06 4/524 |
| 7,784,118 | B2 * | 8/2010 | Lee | A61H 33/06 4/524 |
| 8,499,374 | B2 * | 8/2013 | Belkin | A61H 33/14 4/524 |
| 2003/0156831 | A1 * | 8/2003 | Schaeffer | A61N 5/06 392/416 |
| 2009/0019634 | A1 * | 1/2009 | Lipponen | A61H 9/0071 4/524 |
| 2011/0209283 | A1 * | 9/2011 | Chen | A61H 33/066 4/524 |

FOREIGN PATENT DOCUMENTS

KR 20-04590790000 2/2012

* cited by examiner

*Primary Examiner* — Lori Baker
(74) *Attorney, Agent, or Firm* — Swanson & Bratschun, L.L.C.

(57) ABSTRACT

A sauna apparatus for a half-body bath including a body having a concave structure surrounded with a bottom surface located horizontally on the ground and at least three surfaces connected to the bottom surface. The sauna apparatus also includes a first heating part and a seat disposed at the inside thereof. The sauna apparatus further includes a cover connected on top of the body that is movable-up and down to open and close the interior of the body. The sauna apparatus also includes a second heating part in the cover and shock absorbers to connect the body and the cover with each other. In addition, the sauna apparatus includes a seat driving part to move the seat in an advancing or opposite direction.

1 Claim, 8 Drawing Sheets

SAUNA APPARATUS FOR HALF-BODY BATH

RELATED APPLICATIONS

This application claims the benefit of Korean Patent Application No. 10-2014-0124404 filed Sep. 18, 2014, entitled "Sauna Apparatus for Half-Body Bath", which application is incorporated herein in its entirety by reference.

FIELD OF THE INVENTION

The present invention relates to a sauna apparatus for a half-body bath.

BACKGROUND OF THE RELATED ART

As many people are interested in their health care, recently, half-body bathing machines have been suggested to allow bathers to easily take their half-body baths at their home. One of conventional half-body bathing machines is disclosed in Korean Utility Model Registration No. 20-0459079.

The conventional half-body bathing machine includes a heating member disposed at the interior of a body and a housing of the body is made of timber in which phytoncide components are contained, thus providing anti-bacteria action and forest aromatic bathing effects.

According to such dry half-body bathing machine, a bather enters the open portion formed on the body to sit on the inside of the half-body bathing machine, and in this state, he or she takes a bath. However, the open portion formed on the body is so small that a bather whose body is hard to freely move cannot be easily seated in the interior of the half-body bathing machine.

In addition, the conventional half-body bathing machine is bulky in size, thus inconveniently needing a relatively large area for keeping it in a given place.

SUMMARY OF THE INVENTION

Accordingly, the present invention has been made in view of the above-mentioned problems occurring in the prior art, and it is an object of the present invention to provide a sauna apparatus for a half-body bath that has a cover adapted to open vertically, thus allowing a bather to easily move to the interior of a body thereof.

It is another object of the present invention to provide a sauna apparatus for a half-body bath that is capable of adjusting the position of a seat and further controlling the inclination of a back rest according to the adjustment of the position of the seat, thus allowing a bather to take a sauna, while lying inside the sauna apparatus.

To accomplish the above-mentioned objects, according to the present invention, there is provided a sauna apparatus for a half-body bath including: a body having a concave structure surrounded with a bottom surface located horizontally on the ground and at least three surfaces connected to the bottom surface and having a first heating part and a seat disposed at the inside thereof; a cover connectedly placed on top of the body in such a manner as to move up and down by a force applied thereto to open and close the interior of the body and having a second heating part disposed at the inside thereof; shock absorbers adapted to connect the body and the cover with each other; and a seat driving part adapted to generate power according to input signals applied thereto to move the seat in an advancing direction or in an opposite direction to the advancing direction.

According to the present invention, desirably, the sauna apparatus further includes a back rest located inside the body in such a manner as to be connected to the seat, the inclination of the back rest being decreased or increased as the seat moves in the advancing direction or in the opposite direction to the advancing direction.

According to the present invention, desirably, the sauna apparatus further includes a neck rest connected to the back rest in such a manner as to open or close the top of the body by means of a force applied thereto and having a neck support mounted thereon.

According to the present invention, desirably, the neck rest includes a pair of coupling through holes formed longitudinally thereon, and the neck support includes a pair of protrusions inserted into the pair of coupling through holes, so that the neck support is fixedly coupled to the neck rest through the insertion of the pair of protrusions of the neck support into the pair of coupling through holes of the neck rest.

BRIEF DESCRIPTION OF THE DRAWINGS

The above and other objects, features and advantages of the present invention will be apparent from the following detailed description of the preferred embodiments of the invention in conjunction with the accompanying drawings, in which.

EXPLANATION OF ESSENTIAL REFERENCE NUMERALS IN DRAWINGS

Figure 1:
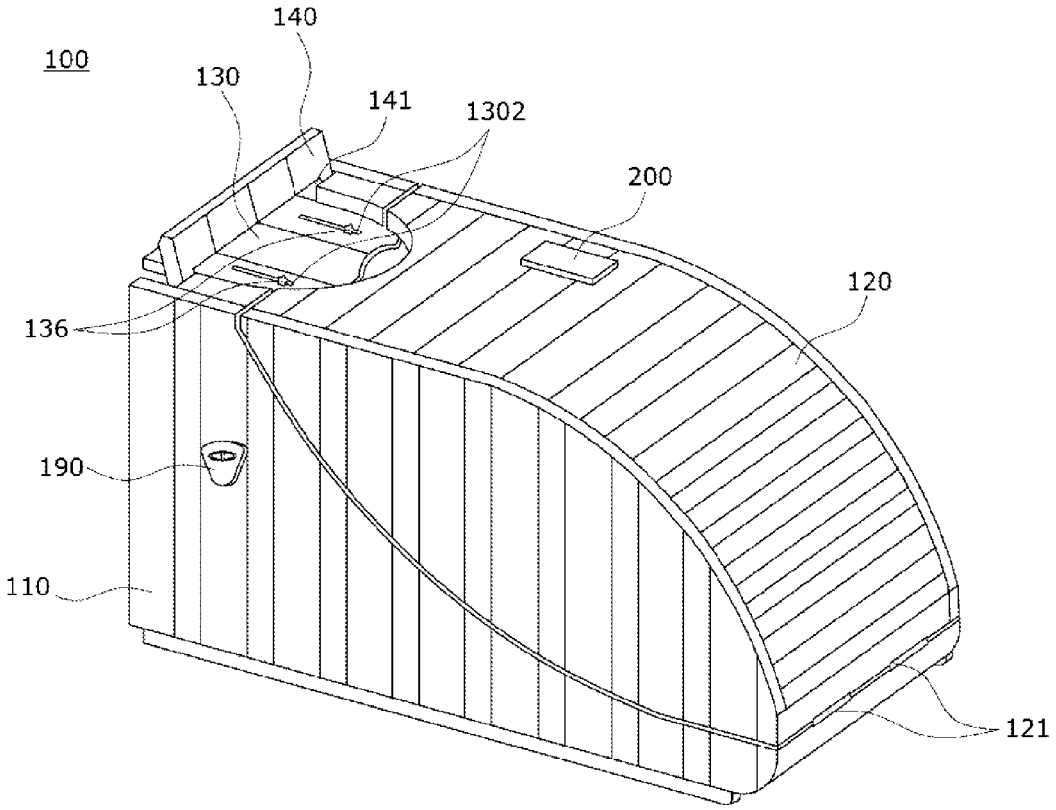
FIG. 1 is a perspective view showing a sauna apparatus for a half-body bath according to the present invention.

| | |
|---|---|
| 100: sauna apparatus | 110: body |
| 120: cover | 130: neck rest |
| 135: neck support | 200: manipulation and display part |
| 310: first heating part | 320: second heating part |
| 400: seat driving part | 610: seat |
| 620: back rest | |

DETAILED DESCRIPTION OF THE PREFERRED EMBODIMENTS

Hereinafter, an explanation on a sauna apparatus for a half-body bath according to the present invention will be in detail given with reference to the attached drawing. In the description, furthermore, a detailed explanation on the well known functions and components of the present invention will be avoided for the brevity of the description.

Referring to FIGS. 1 to 6, first, an explanation on the configuration of a sauna apparatus for a half-body bath according to the present invention will be in detail given.

According to the present invention, a sauna apparatus 100 for a half-body bath includes a body 110, a cover 120 adapted to cover a portion of top of the body 110, a neck rest 130 adapted to cover a portion of the rest of top of the body 110, on which the cover 120 is not located, in such a manner as to be passed through a through hole 141 formed on a support 140, a back rest 620 disposed under the neck rest 130, and a seat 610 connected to the back rest 620 and moving in position by means of a force applied from the outside thereto.

The body 110 has a given size capable of allowing a bather using the sauna apparatus 100 for a half-body bath to be located therein, and desirably, the body 110 has a given size capable of allowing the bather's lower body to be placed therein.

Further, the interior of the body 110 desirably has a concave structure so that the bather can be located therein.

Figure 2:
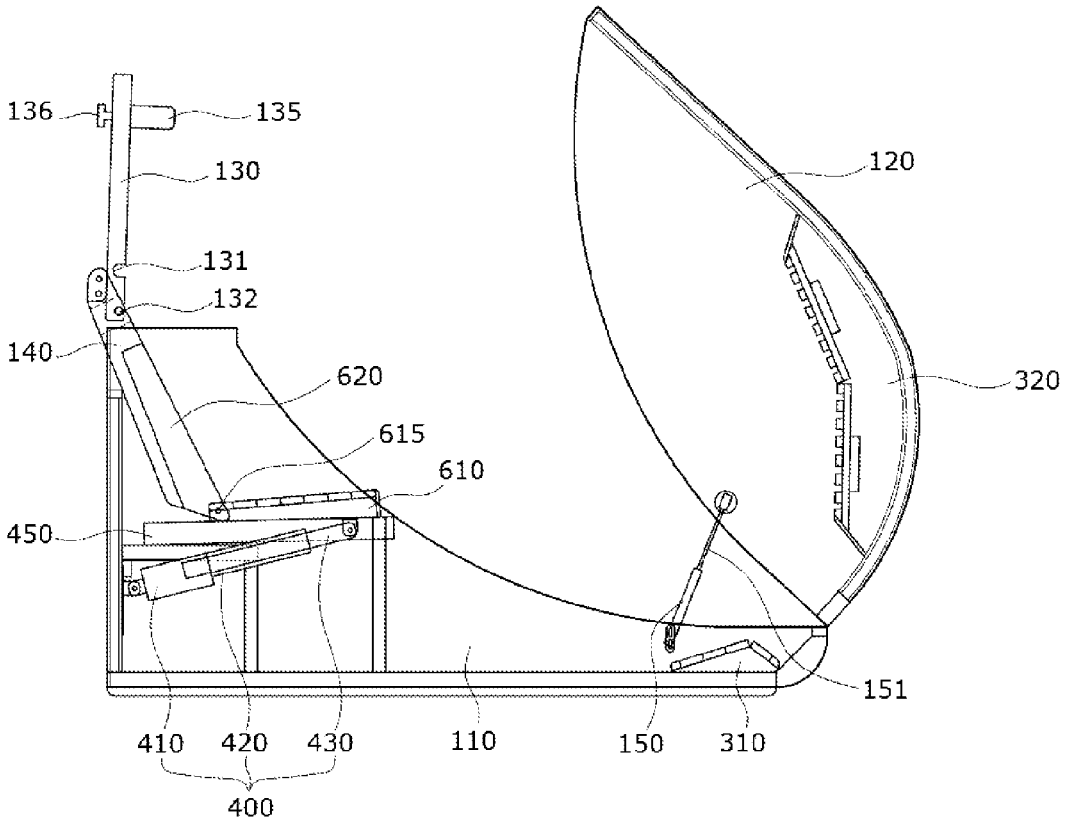
FIG. 2 is a side view showing the sauna apparatus for a half-body bath according to the present invention, wherein a cover is open from a body.
Figure 3:
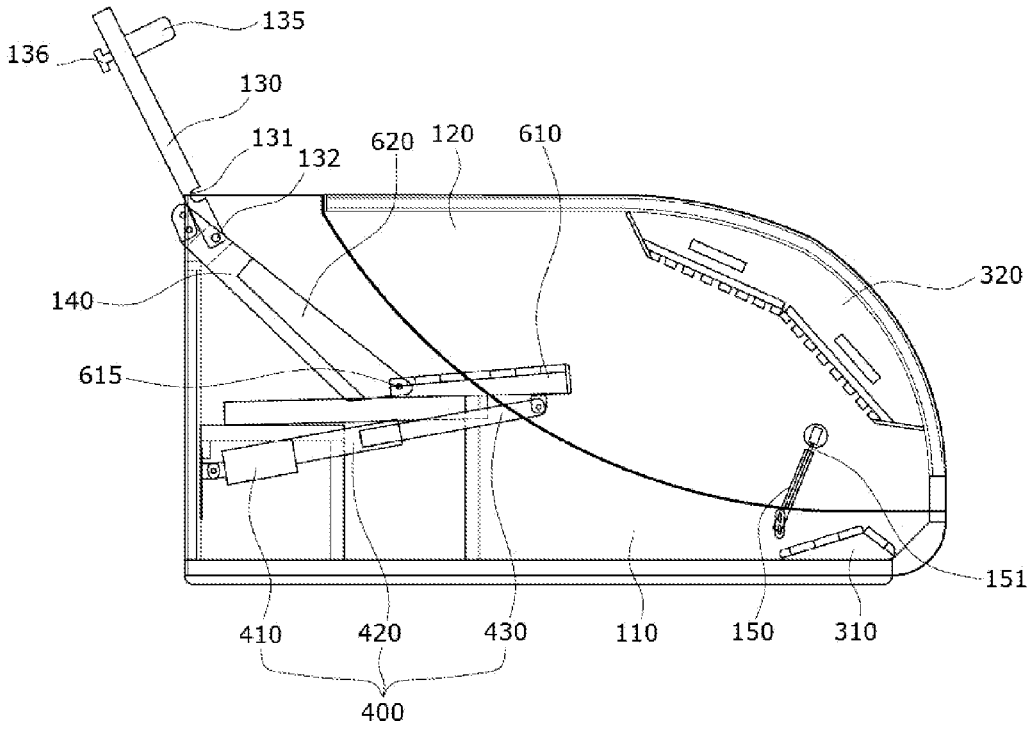
FIG. 3 is a side view showing the sauna apparatus for a half-body bath according to the present invention, wherein the cover is closed on the body.

Referring in detail to FIGS. 1 to 3, the body 110 has a flat bottom surface so that when the sauna apparatus 100 for a half-body bath is located on flat ground, it can be placed horizontally on the ground.

At this time, the bottom surface of the body 110 has a generally rectangular shape, and the body 110 further includes two flat side surfaces connected to two facing edges in four edges constituting the bottom surface thereof and a flat rear surface located between the two side surfaces and connected to one edge of the bottom surface.

Under the above configuration, accordingly, one side surface, the rear surface and the other side surface are connected along the three edges in the four edges of the bottom surface of the body 110. The two side surfaces and one rear surface are located vertically from the bottom surface of the body 110, and they become the side surfaces of the body 110.

At this time, the two side surfaces are desirably elongated along the longitudinal direction of the bather's body to be located inside the body 110.

Accordingly, the body 110 includes the bottom surface located horizontally on the ground and the three side surfaces (two side surfaces and one rear surface) located along the three adjacent edges of the bottom surface, so that when the bather's body using the sauna apparatus 100 is located inside the body 110, his or her body is surrounded with the side surfaces and the bottom surface.

Further, the body 110 includes a front surface connected vertically to the bottom surface thereof on one edge not connected to the side surfaces in the four edges of the bottom surface thereof.

At this time, the front surface may be flat or curved, and the height of the front surface is desirably lower than that of the rear surface.

Further, the two side surfaces of the body 110 have the corresponding shapes to the cross sectional shape of the cover 120, and according to the present invention, the body 110 may have a spiral-shaped portion formed on a portion of each side surface of the body 110 in such a manner as to correspond to a spiral shape of the cover 120.

The body 110 has a first heating part 310 disposed at the inside thereof, and the first heating part 310 is placed at a position on which the bather's feet are rested when he or she is located in the body 110 of the sauna apparatus 100, that is, at the front surface of the body 110.

The first heating part 310 desirably has a given slope.

The first heating part 310 generates heat to a given set temperature.

The body 110 further includes a seat support 450 adapted to locate the seat 610 to a given height, and the underside of the seat 610 is connected to a seat driving part 400, so that the seat 610 moves in a first or second direction by means of the force applied from the seat driving part 400.

Next, the connection relation between the seat 610 and the seat driving part 400 will be explained with reference to FIGS. 2 and 3. The seat driving part 400 has a power generator 410, a first power transmitter 420 and a second power transmitter 430, and the second power transmitter 430 is connected to the seat 610.

For example, the power generator 410 generates first power that extends the second power transmitter 430 or generates second power that reduces the second power transmitter 430 in accordance with signals applied thereto, and transmits the generated first or second power to the first power transmitter 420.

The power generator 410 is desirably formed of a motor, and the power generator 410 generates the first power or the second power in accordance with the signals inputted to the angle adjusting part 190 attached to the sauna apparatus 100 and transmits the generated first or second power to the first power transmitter 420.

For example, the angle adjusting part 190 includes an input button having a shape of an arrow indicating a direction, and a movement requesting signal generated by the pressing of the input button is transmitted to the power generator 410.

The first power transmitter 420 extends or reduces the second power transmitter 430 by means of the first power or the second power transmitted from the power generator 410.

Accordingly, the second power transmitter 430 is extended or reduced by means of the first power or the second power transmitted from the first power transmitter 420 and moves the seat 610 in the first or second direction.

At this time, the first direction in the movement of the seat 610 is set from the rear surface of the body 110 toward the front surface thereof, and the second direction in the movement of the seat 610 is set from the front surface of the body 110 toward the rear surface thereof.

Next, the back rest 620 is connected to the seat 610 by means of a second connector 615. While the seat 610 is moving to the first direction, the inclination of the seat 610 becomes decreased, and while the seat 610 is moving to the second direction, the inclination thereof becomes increased.

The back rest 620 is a portion against which the bather's back is supported when his or her body is located inside the body 110, and as the inclination of the back rest 620 is decreased, the bather can use the sauna apparatus 100 comfortably in the state of lying inside the body 110.

Further, at this time, the other end portion of the back rest 620 not connected through the second connector 615 is connected to the neck rest 130 by means of a first connector 132.

Figure 4A:
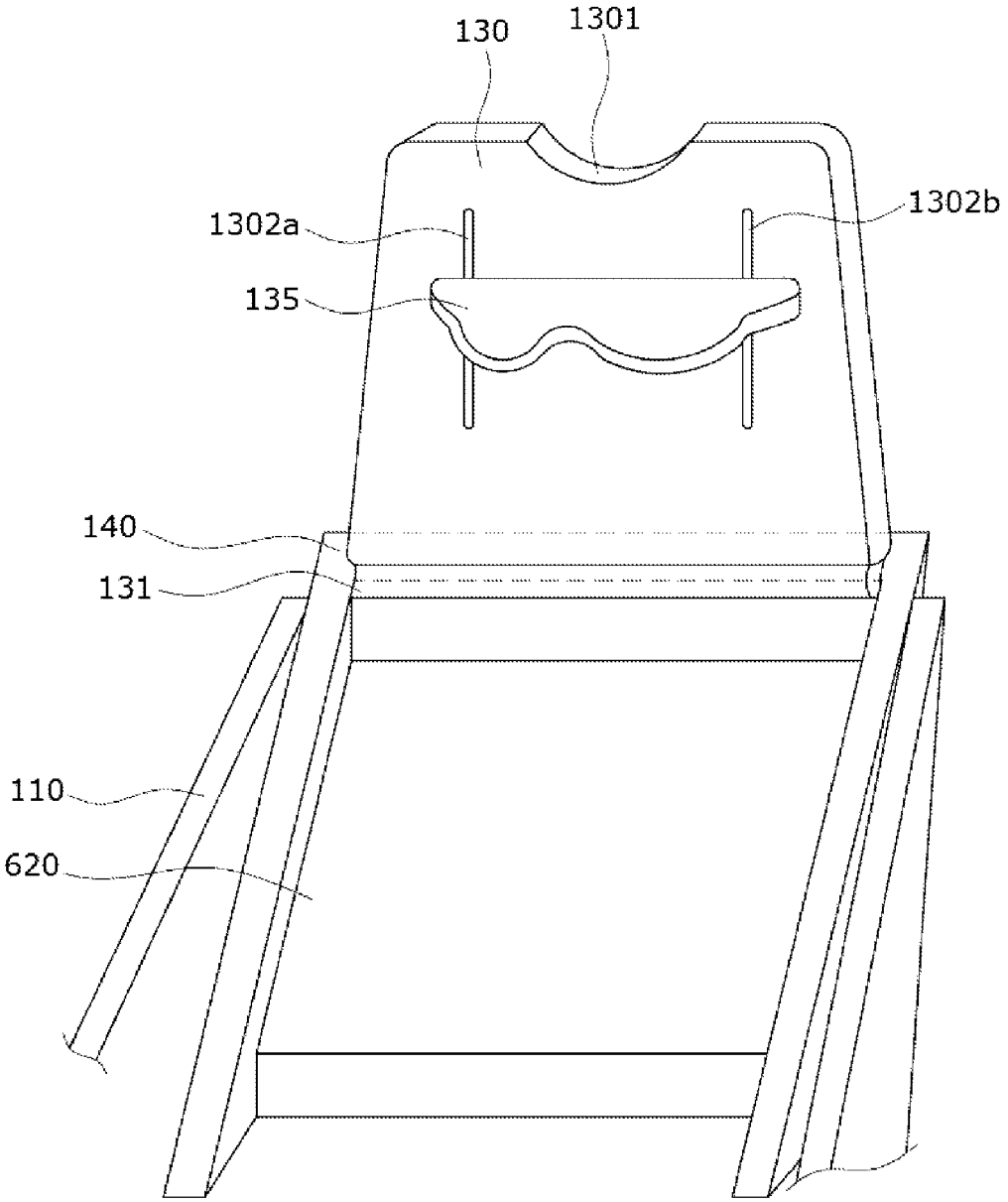
FIG. 4A is a front view showing a neck rest of the sauna apparatus for a half-body bath according to the present invention.

Now, the structures of the neck rest 130 and the support 140 and their connection relation will be explained with reference to FIGS. 4A to 4C and FIG. 5. When the support 140 is viewed on a front side as shown in FIG. 4A, first, the side portions of the support 140 are adjacent to the inner surfaces of the body 110, and a portion connecting the side portions of the support 140 is located at a higher position than the rear surface of the body 110.

Figure 4B:
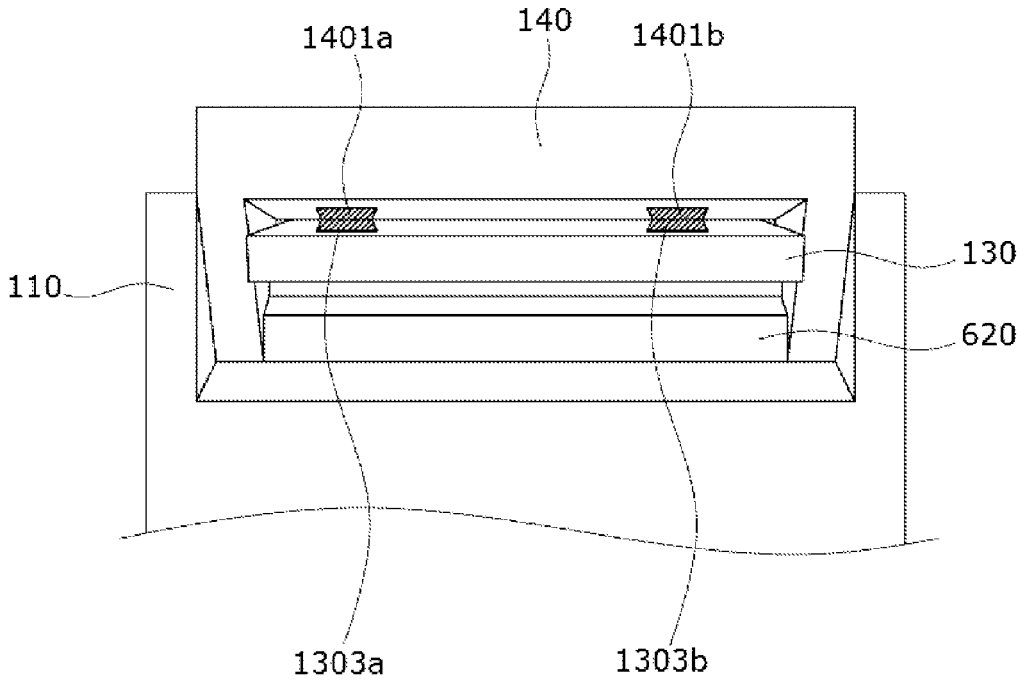
FIG. 4B is a back view showing a folded state of the neck rest of the sauna apparatus for a half-body bath according to the present invention.
Figure 4C:
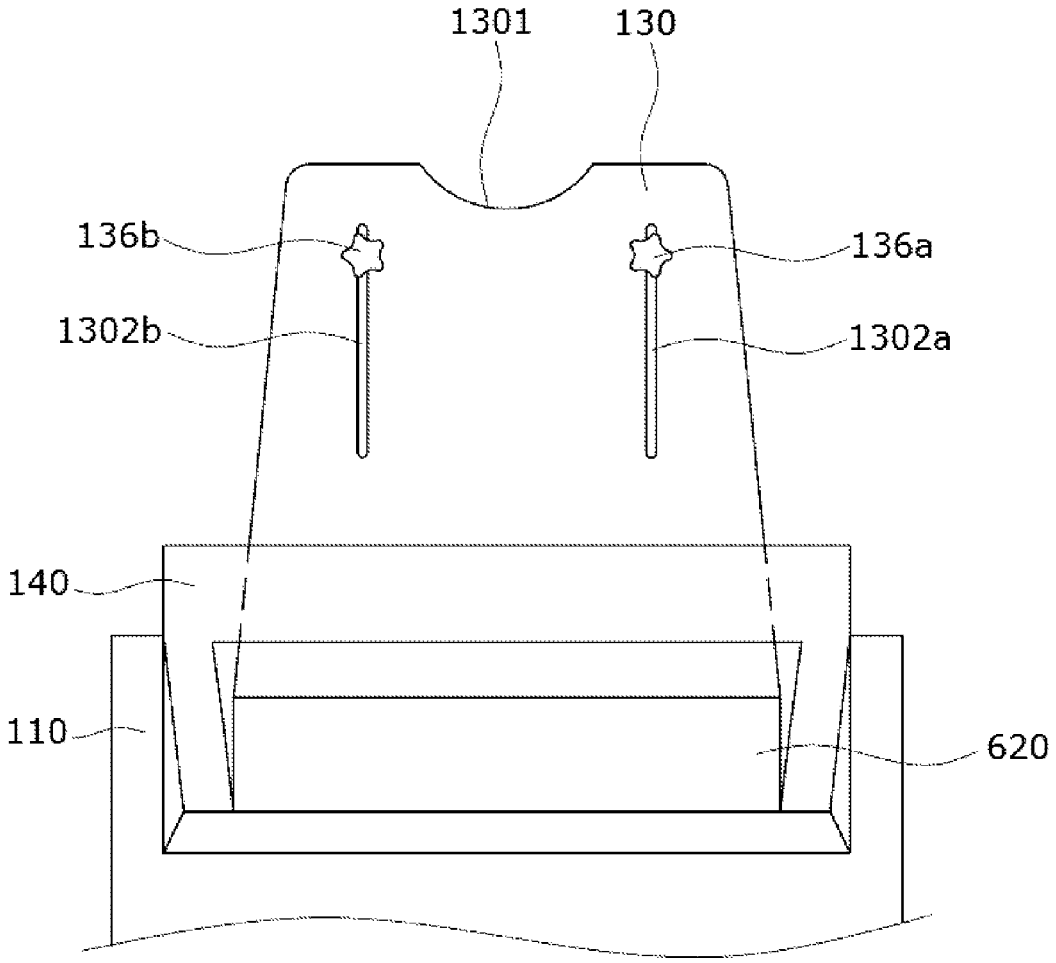
FIG. 4C is a back view showing an unfolded state of the neck rest of the sauna apparatus for a half-body bath according to the present invention.

When the support 140 is viewed on a rear side as shown in FIGS. 4B and 4C, further, the support 140 includes three continuous edges in which two adjacent edges have a given angle, for example, a right angle to each other, thus forming a space surrounded with the three edges, and the space becomes a through hole 141 as shown in FIG. 1, through which the neck rest 130 is passed.

The support 140 is adapted to support the neck rest 130 thereagainst and located on the underside of the neck rest 130 along both side surfaces of the back rest 620.

The neck rest 130 is adapted to support the back of the neck of the bather located inside the body 110 of the sauna apparatus 100, and as mentioned above, the neck rest 130 is passed through the through hole 141 formed by the support 140, while being connected to the support 140.

The neck rest 130 has a structure in which a neck support 135 is coupled to a coupling through hole portion 1302 (1302*a* and 1302*b*).

The neck rest 130 has a groove 1301 formed on one end portion thereof.

For example, the neck rest 130 is located in the state of being unfolded state as shown in FIGS. 4A and 4C or being folded state as shown in FIG. 4B, in accordance with the forces applied thereto.

In case where the neck rest 130 is unfolded, a portion of the lower end portion of the neck rest 130 is seen from the rear side through the through hole 141 of the support 140, as shown in FIG. 4C, and at this time, the neck rest 130 becomes located at the end portion of the back rest 620.

In case where the neck rest 130 is folded, as shown in FIG. 4B, the lower end portion of the neck rest 130 is connected to the lower portion of the support 140 by means of a first upper hinge 1401*a* and a second upper hinge 1401*b* disposed on the support 140 and a first lower hinge 1303*a* and a second lower hinge 1303*b* disposed on the lower portion of the neck rest 130.

In more detail, the first lower hinge 1303*a* and the second lower hinge 1303*b* disposed on the lower portion of the neck rest 130 are connected correspondingly to the first upper hinge 1401*a* and the second upper hinge 1401*b* disposed on the support 140, so that when a force is applied to the neck rest 130, the neck rest 130 connected to the support 140 is unfolded or folded around the support 140.

At this time, the folded neck rest 130 is located passed through the through hole 141 of the support 140, and also, the neck rest 130 and the back rest 620 are not connected to each other, so that when the neck rest 130 is folded as shown in FIG. 4B, the folded neck rest 130 can be naturally located over the back rest 620 by means of the groove 1301 formed on the neck rest 130.

Further, the height of the folded neck rest 130 is lower than the maximum heights of the body 110 and the cover 120, as shown in FIG. 1, so that the folded neck rest 130 is desirably located inside the body 110 and the cover 120.

Figure 5:
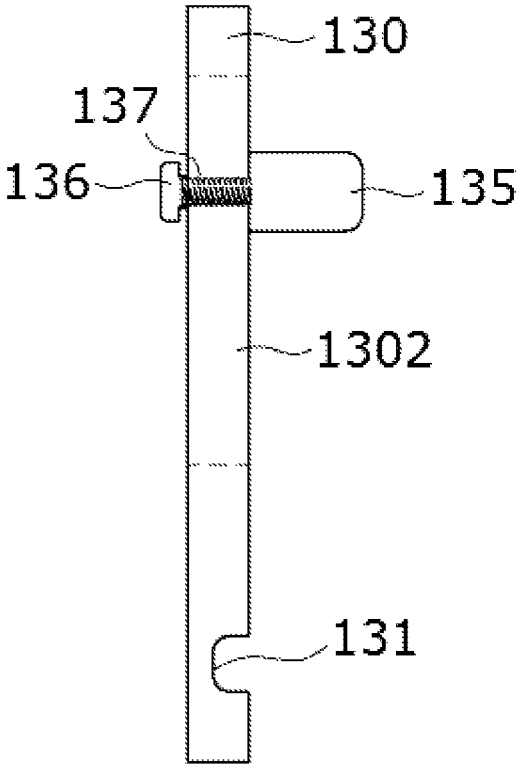
FIG. 5 is a side view showing the neck rest of the sauna apparatus for a half-body bath according to the present invention.

Next, an explanation on the coupling structure wherein the neck support 135 is coupled to the coupling through hole portion 1302 formed on the neck rest 130 will be given with reference to FIGS. 4A and 5. First, the neck support 135 is passed through the coupling through hole portion 1302 (that is, one pair of through holes 1302*a* and 1302*b*) formed on the neck rest 130 and fixed thereto. At this time, the neck support 135 has a pair of protrusions 137 having the corresponding size to the pair of coupling through holes 1302*a* and 1302*b*, so that the neck support 135 is passed through the coupling through hole portion 1302 and fixedly coupled to the neck rest 130.

At this time, the pair of protrusions 137 formed protrudingly from the neck support 135 is coupled to fixing parts 136, and accordingly, the neck support 135 can be rigidly fixed to the neck rest 130.

For example, the pair of protrusions 137 desirably protrudes in a shape of a screw and is coupled correspondingly to the pair of coupling through holes 1302*a* and 1302*b*.

Like this, the neck support 135 having one pair of protrusions 137 formed on the rear surface thereof has a curved protruding structure, as shown in FIG. 4A, so that when the bather using the sauna apparatus 100 is located inside the body 110 and places his or her head on the neck rest 130, he or she can take a comfortable posture.

Further, as shown, he or she can place the back of his or her neck on the curved structure of the neck support 135 comfortably.

At this time, further, the pair of protrusions 137 of the neck support 135 is passed through other points of the pair of coupling through holes 1302*a* and 1302*b* and fixedly coupled to the neck rest 130 by means of the fixing parts 136, so that even if bathers using the sauna apparatus 100 have different heights from each other, they can use the sauna apparatus 100, while the back of their neck is resting on the neck support 135 comfortably.

Figure 6:
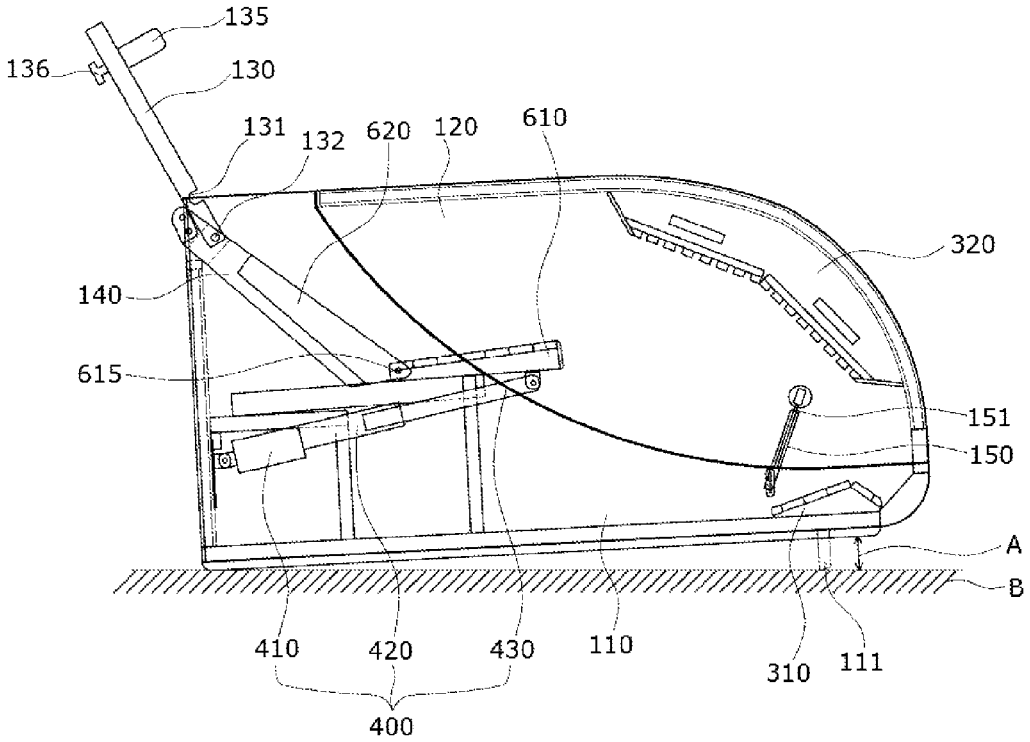
FIG. 6 is a side view showing an unfolded state of an angle adjusting part of the sauna apparatus for a half-body bath according to the present invention.

Referring next to FIGS. 1 to 3 and 6, an explanation on the cover 120 will be in detail given. The cover 120 is located on top of the body 110 in such a manner as to be open as shown in FIG. 2 or closed as shown in FIG. 1, 3 or 6, by means of the force applied from the outside.

According to the present invention, the cover 120 has three surfaces, and at this time, as shown in FIG. 1, the cover 120 has an intermediate surface whose a portion is curved and two flat side surfaces connected to both edges of the intermediate surface.

The end portion of the intermediate surface of the cover 120 is connected to the end portion of the front surface of the body 110 by means of hinges 121.

At this time, the end portions of the side surfaces connected to both edges of the intermediate surface of the cover 120, that is, the portions to be brought into contact with the side surfaces of the body 110 have the corresponding shapes to the end portions of the side surfaces of the body 110. According to the present invention, preferably, the end portions of the side surfaces of the cover 120 are curved as shown in FIGS. 2, 3 and 6.

A portion of the intermediate surface of the cover 120, which is ranged from a portion to be brought into contact with the front surface of the body 110 to a portion reaching the top of the cover 120, is curved, but a portion of the top of the intermediate surface of the cover 120 is flat like the neck rest 130.

Further, as shown in FIG. 6, the cover 120 includes shock absorbers 150 disposed on the end portions of the cover 120 to be brought into contact with the side surfaces of the body 110, and when the cover 120 is open or closed from or on the body 110 by means of the force applied from the outside, it can be stably open and closed by the hydraulic pressure of the shock absorbers 150.

At this time, if the cover 120 is connected to the body 110 by means of the hinges 121, the cover 120 is first open and closed from and on the body 110 through the hinge coupling, and next, the cover 120 is adjusted in opening angles and gentle opening and closing speed through the shock absorbers 150.

The intermediate surface of the cover 120 has a second heating part 320 disposed on the inside thereof, and when the bather using the sauna apparatus 100 places his or her body inside the body 110, the second heating part 320 irradiates heat on his or her whole body (desirably, his or her lower body).

According to the present invention, the sauna apparatus 100 further includes a manipulation and display part 200 disposed on the external surface of the cover 120 or the body 110 to manipulate the operations thereof or to display the states thereof.

The manipulation and display part 200 receives input signals from the outside of the sauna apparatus 100 and performs the operation of controlling the activation of the first heating part 310 and the second heating part 320, the operation of adjusting the temperature of the heat generated from the first heating part 310 and the second heating part 320, and the operation of displaying the temperature of the heat being generated from the first heating part 310 and the second heating part 320, in accordance with the input signals applied thereto.

At this time, the manipulation and display part 200 includes buttons, and otherwise, it may include a touch panel.

Even if not shown in the drawing, further, the sauna apparatus 100 having the manipulation and display part 200 includes a power transmitter for transmitting power applied from the outside and a controller for generating a control signal controlling the power transmitter or a control signal controlling the temperature of the heat generated from the first heating part 310 and the second heating part 320, in accordance with the manipulation signals inputted thereto.

According to the present invention, as shown in FIG. 6, the body 110 further includes a base 111 disposed on the bottom surface brought into contact with the ground in such a manner as to be folded or unfolded by means of the force applied from the outside.

The base 111 is generally folded, and when folded, it does not give any influence on the height of the sauna apparatus 100.

However, if the base 111 is unfolded and brought into contact with the ground, the base 111 supports the ground B thereagainst to allow the height of the sauna apparatus 100 to be increased by a length A of the base 111.

At this time, the base 111 is disposed on the front portion of the sauna apparatus 100, desirably, under the portion on which the first heating part 310 is located, thus making the front portion of the sauna apparatus 100 located higher.

The sauna apparatus 100 has the base 111, and as the base 111 is unfolded, the bather using the sauna apparatus 100 can take a half-body bath in more comfortable manner.

Next, an explanation on the bather's half-body bathing operation through the sauna apparatus 100 according to the present invention will be in detail given with reference to FIGS. 1 to 6.

First, the sauna apparatus 100 is located in the state where the cover 120 is closed, as shown in FIG. 1, and next, a force is applied to the cover 120 from the bather to open the cover 120, as shown in FIG. 2.

At this time, the cover 120 is slowly lifted up by means of the shock absorbers 150.

Next, a force is applied to the neck rest 130 from the bather to unfold the neck rest 130, and after that, the bather's body is located inside the body 110.

At this time, the bather sits on the seat 610, while placing his or her feet on top of the first heating part 310, locating his or her back on the back rest 620, and especially resting the back of his or her neck on the neck support 135.

According to the present invention, the height of the neck support 135 is adjusted to allow the position of the neck support 135 to correspond to his or her sitting height, that is, to correspond to the position of the back of his or her neck. At this time, the location of the neck support 135 is adjustable by means of fastening or unfastening of the fixing parts 136 and the protrusions 137.

Next, a force is applied to the cover 120 from the bather to pull the cover 120 down toward the body 110.

As a result, the cover 120 being open, as shown in FIG. 2, is closed, as shown in FIG. 3, and the entire portion of the bather excepting the portion of his or her body resting on the neck rest 130 and the neck support 135 is located inside the cover 120 and the body 110, so that most of his or her body using the sauna apparatus 110 is surrounded with the cover 120 and the body 110.

Before the cover 120 is closed by the application of the force from the bather thereto, at this time, signals are applied to the manipulation and display part 200 to activate the heating of the first heating part 310 and the second heating part 320 and to adjust the heating temperatures thereof.

Moreover, since it is hard to emit the heat generated from the internal space surrounded with the cover 120 and the body 110 to the outside, the heat is transmitted to the bather's whole body as well as his or her lower body, so that he or she using the sauna apparatus 100 can take a dry sauna.

So as to adjust the angle of the back rest 620, further, if a signal is applied to the angle adjusting part 190 from the bather, power is generated from the power generator 410 according to the applied signal, and the power generated from the power generator 410 is transmitted to the first power transmitter 420 and the second power transmitter 430. Next, the seat 610 connected to the second power transmitter 430 moves in the first direction, and accordingly, the seat 610 placed in position, as shown in FIG. 2, moves to the position, as shown in FIG. 3.

Accordingly, the back rest 620 connected to the seat 610 by means of the second connector 615 is changed in inclination from the state as shown in FIG. 2 to the state as shown in FIG. 3.

Like this, the arrow button is pressed by means of the bather to move the location of the seat 610, thus making the inclination of the back rest 620 decreased, so that the bather can take a half body bathing, while lying inside the sauna apparatus 100.

If necessary, the manipulation and display part 200 is manipulated to adjust the heating temperatures of the first heating part 310 and the second heating part 320 or to stop their heating, and according to the present invention, the manipulation and display part 200 is placed on the surface of the sauna apparatus 100, as shown in FIG. 1, so that after a force is applied to the cover 120 from the bather to open the cover 120, a given input signal is applied to the manipulation and display part 200.

After the half-body bathing is finished, a force is applied to the cover 120 from the bather to open the cover 120, and he or she gets out of the body 110. Next, a given input signal is applied to the manipulation and display part 200 to stop the activation of the first heating part 310 and the second heating part 320.

So as to return the seat 610 and the back rest 620 to their original position, at this time, a given input signal is applied to the angle adjusting part 190 to operate the seat driving part 400, thus allowing the seat 610 to move in the second direction. Accordingly, the back rest 620 is returned in inclination from the location as shown in FIG. 3 to the location as shown in FIG. 2.

Lastly, a force is applied to the neck rest 130 from the bather to fold the unfolded neck rest 130, and also, a force is applied to the cover 120 from the bather to close the cover 120, so that after the sauna apparatus 100 is used, as shown in FIG. 6, the base 111 is folded and located on the underside of the body 110.

Like this, the bather can take a dry sauna, while his or her body is located inside the sauna apparatus 100, and the bathing can be more comfortably taken through the adjustment of the position of the seat 610 and the angle of the back rest 620.

Further, the position of the neck support 135 is adjusted to correspond to the bather's height, thus allowing him or her to take a half-body bath more conveniently.

As described above, the sauna apparatus for a half-body bath according to the present invention is provided with the shock absorbers connecting the cover and the body with each other, thus allowing the cover to be open and closed vertically.

Further, the sauna apparatus for a half-body bath according to the present invention is provided with the seat that moves in the first direction or in the second direction opposite to the first direction by means of the seat driving part, so that the back rest connected to the seat is changed in inclination, thus making the bather located inside the sauna apparatus take a half-body bath comfortably.

Furthermore, the sauna apparatus for a half-body bath according to the present invention is provided with the neck support connected to the neck rest that is adjusted in position, thus making bathers having different heights take a half-body bath, while resting the back of their neck on the neck support.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. Further, the present invention is applicable to sport shoes reducing knee adduction moments.

What is claimed is:

1. A sauna apparatus for a half-body bath comprising:

a body having a concave structure surrounded with a bottom surface located horizontally on the ground and at least three surfaces connected to the bottom surface and comprising a first heating part and a seat disposed at the inside thereof;

a cover connectedly placed on top of the body in such a manner as to be movable up and down by a force applied thereto to open and close the interior of the body, said cover having a second heating part disposed at the inside thereof;

shock absorbers connecting the body and the cover with each other;

a seat driving part to generate power according to input signals applied thereto to move the seat in an advancing direction or in an opposite direction to the advancing direction;

a back rest located inside the body and connected to the seat, an inclination of the back rest being decreased or increased as the seat moves in the advancing direction or in the opposite direction to the advancing direction; and a neck rest connected to the back rest to open or close the top of the body and having a neck support mounted thereon, wherein the neck rest comprises a pair of coupling through holes formed longitudinally thereon, and the neck support comprises a pair of protrusions inserted into the pair of coupling through holes, so that the neck support is fixedly coupled to the neck rest through the insertion of the pair of protrusions of the neck support into the pair of coupling through holes of the neck rest.

* * * * *